US006503097B2

(12) United States Patent
Archambault

(10) Patent No.: US 6,503,097 B2
(45) Date of Patent: Jan. 7, 2003

(54) ELECTRICAL OUTLET CORD SUPPORT

(76) Inventor: Francis Archambault, 94, avenue du Lac, Rouyn-Noranda, (Québec) (CA), J9X 4N4

( * ) Notice: Subject to any disclaimer, the term of this patent is extended or adjusted under 35 U.S.C. 154(b) by 0 days.

(21) Appl. No.: 09/987,794

(22) Filed: Nov. 16, 2001

(65) Prior Publication Data

US 2002/0061678 A1 May 23, 2002

Related U.S. Application Data

(60) Provisional application No. 60/249,437, filed on Nov. 20, 2000.

(51) Int. Cl.[7] ..... H01R 13/72
(52) U.S. Cl. ..... 439/501; 439/4
(58) Field of Search ..... 439/4, 501; 174/66

(56) References Cited

U.S. PATENT DOCUMENTS

| | | | | |
|---|---|---|---|---|
| 2,231,001 A | | 2/1941 | Engstrom | |
| 2,438,143 A | | 3/1948 | Brown | |
| 2,510,745 A | | 6/1950 | Kilgore | |
| 3,013,105 A | | 12/1961 | Craig | |
| 3,042,739 A | | 7/1962 | Craig | |
| 3,257,497 A | | 6/1966 | Chase | |
| 3,689,868 A | | 9/1972 | Snyder | |
| 6,036,536 A | * | 3/2000 | Chiu | 439/536 |

* cited by examiner

*Primary Examiner*—Gary Paumen
*Assistant Examiner*—Ann McCamey
(74) *Attorney, Agent, or Firm*—Francois Martineau

(57) ABSTRACT

A spool support for supporting an elongated electrical cord around an electrical outlet. The spool support defines: a planar open main frame having a central window, for through engagement by the electrical outlet, and a peripheral edge wall, surrounding the central window, this peripheral edge wall including an upper end section and a lower end section; a first arcuate channel member, integral to the main frame upper end section and projecting forwardly from the plane formed by the main frame; a second arcuate channel member, integral to the main frame lower end section and projecting forwardly from the plane formed by the main frame, the first and second channel members extending upwardly and downwardly respectively and forming together a loop for winding thereinto the electrical cord. Screws, not associated with a cover plate for the electrical outlet but operative at the main frame upper end section and at the main frame lower end section, for releasably anchoring the electrical outlet to the spool support.

12 Claims, 5 Drawing Sheets

G
58
56
64
60a
60
R
62
25
36
50c
S
26
54b
52a
29
32
28
50
50b
52
52b
52c
27
16
50a
54a
15
34
30
80
24
18
72
70
71
66a
68
66b
66
35
34a
30a
31
22

ELECTRICAL OUTLET CORD SUPPORT

CROSS-REFERENCE DATA

This application claims convention priority based upon U.S. provisional patent application No. 60/249,437 filed Nov. 20, 2000.

FIELD OF THE INVENTION

This invention relates to electrical outlets, and more particularly to an electrical cord support that can be attached around an electrical outlet on an outdoor building wall to accommodate and conceal the excess amount in length of the electrical cord.

BACKGROUND OF THE INVENTION

Motorists living in sub-freezing climates where the use of block heaters for the motor engine is widely used, require an elongated electrical cord to electrically connect the block heater of their unsheltered automobile to an outdoor wall electrical outlet. When the motorist wants to use his ear, he has to disconnect the electrical cord plug from the block heater and may want to leave the electrical cord simply on the ground, which makes it liable to damages from water and snow borne moisture.

OBJECT OF THE INVENTION

The gist of the present invention is to address the need for a short term tidy and safe storage of an extension cord to be connected to an outdoor electrical outlet, outside of the home.

SUMMARY OF THE INVENTION

In accordance with the object of the invention, there is disclosed a spool support for supporting an elongated electrical cord around an electrical outlet, said spool support defining: a) a planar open main frame having a central window, for through engagement by the electrical outlet, and a peripheral edge wall, surrounding said central window, said peripheral edge wall including a upper end section and a lower end section; b) a first arcuate channel member, integral to said main frame upper end section and projecting outwardly from the plane formed by said main frame; c) a second arcuate channel member, integral to said main frame lower end section and projecting outwardly from the plane formed by said main frame, said first and second channel member extending in opposite directions and forming together a loop for winding thereinto the electrical cord; and d) securing means, not associated with a cover plate for the electrical outlet but operative at said spool support main frame, for releasably anchoring the electrical outlet to said spool support.

The invention also relates to a combination of the electrical outlet and/or the electrical box to the spool support.

Preferably, an upper bridge portion integrally interconnects said main frame upper end section and said first arcuate channel member, and a male member, integrally projecting transversely from said bridge portion, said male member for releasable complementary engagement by the female end plug of the electrical extension cord. Said main frame upper end section could further include two intergral female ear members and said main frame lower end section further includes two integral male ear members, said male ear members complementarily lockingly releasably engaged with said female ear members; wherein said spool support is dismanteable from an assembled unitary state into a disassembled state in two upper and lower halves. Each of said female ear members may have a tapered leading edge, said leading edge forming a ramp enabling sliding intergagement with corresponding male ear members.

A lower bridge portion could also integrally interconnect said main frame lower end section and said first arcuate channel member, said lower bridge portion having a notch, made into said lower bridge portion and opening into said central window, said notch for through passage of the electrical cord wound around said first and second arcuate channel member. Said securing means could consist of at least one bore, made into a selected one of said upper end section and lower end section, and a corresponding number of screw members, extending through said at least one bore for through engagement with registering ears from the electrical outlet and for anchoring with an electrical box behind said spool support.

An electrically insulating sealing pad could be sandwiched in between said electrical box and said spool support main frame upper end section and lower end section, and also ahead forwardly of a cover plate for the outlet.

In said assembled unitary state of said dismantleable spool support, said first and second channel members could engage one another to form a continuous single loop member.

DETAILED DESCRIPTION OF THE PREFERRED EMBODIMENTS OF THE INVENTION

Figure 1:
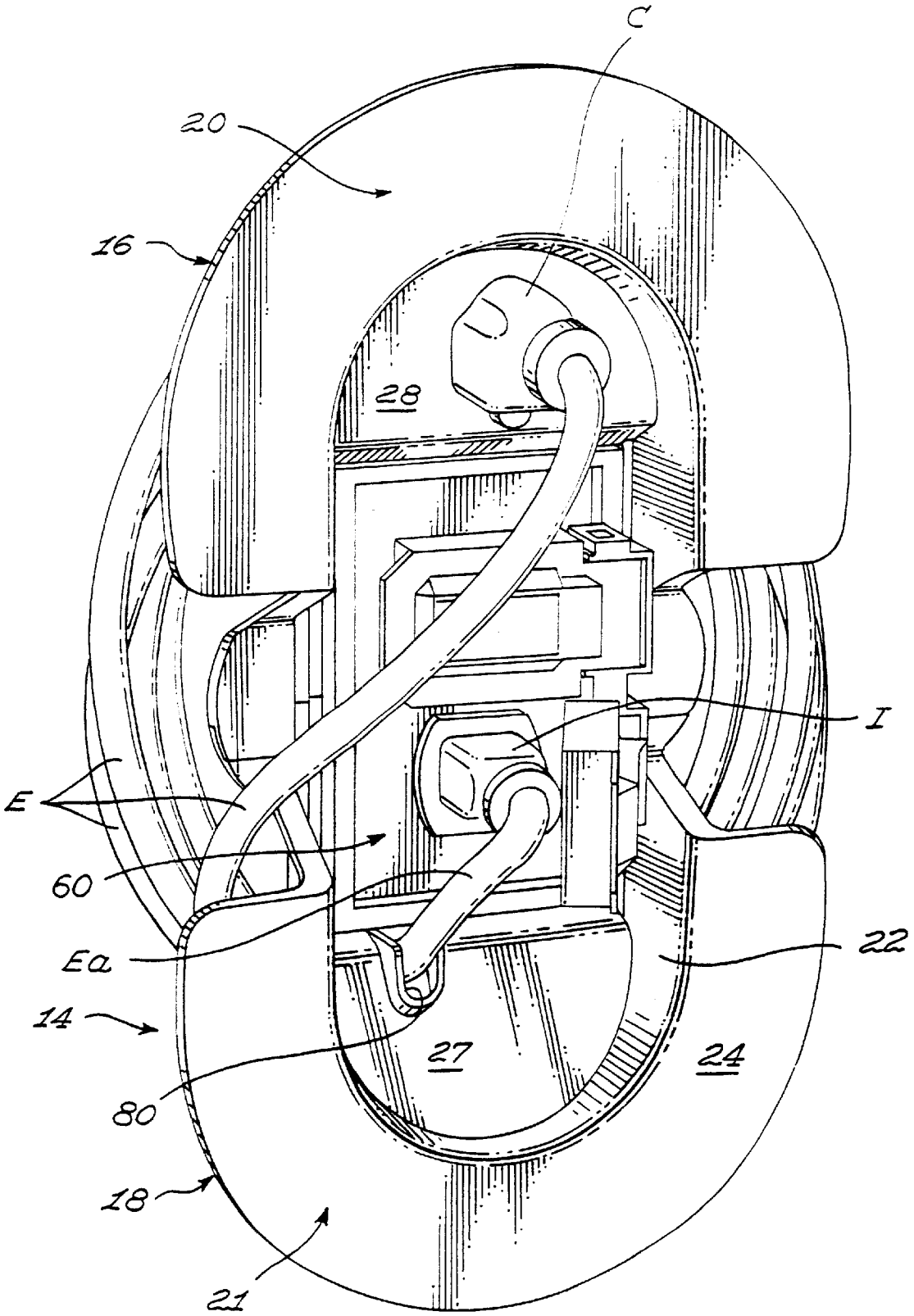
FIG. 1 is a front perspective view of a first embodiment of wall support member for an electrical cord, with this cord shown wound around the spool section thereof and connected at one plug end to the electrical outlet and at the other connector end to an inoperative three-prong male false plug.

In the first embodiment of rigid support member shown as 14 in FIGS. 1 to 4 of the drawings, the spool support 14 is shown as consisting of a central planar window frame member 15 and first and a second arcuate support half sections 16, 18 integrally projecting from opposite end sections of frame member 15 forwardly transversely therefrom. Elements 15, 16, 18, are made from a weather resistant material, for example a thermoplastic material such as high density copolymer polypropylene. Each support half section 16, 18, includes a semi-circular main frame 20, 21, respectively, each of cross-sectionally L-shape having two legs 22, 24 respectively orthogonal to one another, so as to define an arcuate groove or passageway 25, 26 respectively. An inner web 27, 28, transversely joins corresponding support half sections 16, 18, respectively. The top web 28 forms a wall parallel to planar frame 15, and includes a three prong male false plug 29, which can accommodate the three slot female connector C at the end of the extension cord E. Electrical cord E has a length of for example ten meters, or alternately two times five meters. False plug 29 can allow length of for example ten meters, or alternately two times five meters. False plug 29 can allow the female connector C to be stored when not in use in a way that protects the slots of female connector C from accidental ingress of ambiant dust or moisture—a safety hazard. The configuration 29 is not limited to the North American three prong standard (two conductors and one ground) but can be shaped according to standards from other regions of the world, for example an alternate two-prong assembly.

Bottom web 27 forms an inclined wall diverging forwardly downwardly from the plane of planar wall 15. Preferably, window frame 15 is made from two separate U-shape half sections 50, 52, abutting against one another at their free ends. The opposite webs 50*a,* 52*a,* of window frame half sections 50, 52, respectively include a number of bores 54*a,* 54*b,* respectively for through engagement by first screws S. Anchoring ears 56 are also provided at an electrical outlet device 60. The window opening formed within window frame 15 is sized to be freely engaged by box-like casing 62 of outlet device 60, while ears 56, 56, extend forwardly beyond this window opening. Therefore, the dual sockets 64, 64, of outlet device 60 open forwardly of spool support 14, although not necessarily forwardly of the plane of window frame 15 (i.e. that ears 56, 56, could be bent forwardly to allow the sockets 64 to rearwardly sink into the central window opening of window frame 15).

Casing 62 extends rearwardly beyond the plane of window frame 15, to fit into the enclosure 66A of an electrical box 66 through mouth 66B of this box 66. Box 66 includes vertical flanges 68, 68, at the top and bottom ends of mouth 66B, with each flange having a number of threaded bores 70, 70.

When support member 14 is secured between fore outlet ears 56 and aft box flanges 68, the relative position of bores 70 match those of bores 54*a*–54*b,* wherein upon screwing screws S into threaded bores 70 through bores 54*a*–54*b,* the window frame 15 of spool support 14 becomes anchored to the box flanges 68, 68. Another set of screws G extend through ovoidal slots 58 made into ears 56, through intermediate slots 54*c* made in window frame webs 50*a,* 52*a,* and through threaded bores 71 made in the electric box flanges 68, 68. By screwing screws G, spool support 14 becomes fixedly sandwiched between the fore electric outlet ears 56 and the aft electric box flanges 68, 68. However, it is not essential for the present invention that the screws S extend through the lower end section 52*a* of main frame 50, although it can be desirable.

Preferably, a moisture controlling pad 72 is sandwiched between window frame 15 and the frontwall of electrical box 66 including electrical box flanges 68, 68. Pad 72, which may be made e.g. from an insulating foam material such as polystyrene or polyurethane, is pierced with apertures to accommodate therethrough passage of outlet casing 62 and screws S. Pad 72 is for example of the same size and shape than window frame 15.

The window frame upper half section 50 includes two side legs 50*b,* 50*c,* while the lower half section 52 includes two side legs 52*b,* 52*c*. Legs 50*b,* 52*b,* abut coextensively against one another, while legs 50*c,* 52*c,* abut coextensively against one another. To releasably interlock legs 50*b*–50*c* and 52*b*–52*c* in said coextensive abuttal relationship, there is provided interlocking ear members 30, 32, 34 and 36. More particularly, from each of the side legs 50*b,* 50*c,* project diverging coplanar opposite ear members 34, 36, in register with the opposite ends of passageway 26 of this first support half section 16. Similarly, from each of the side legs 52*b,* 52*c,* project diverging coplanar ear members 30, 32, in register with the opposite ends of the passageway 26. Ear members 30 and 34 and ear members 32 and 36 are shaped complementarily to one another so as to be lockingly yet releasably engageable in friction fit fashion.

Figures 2, 3:
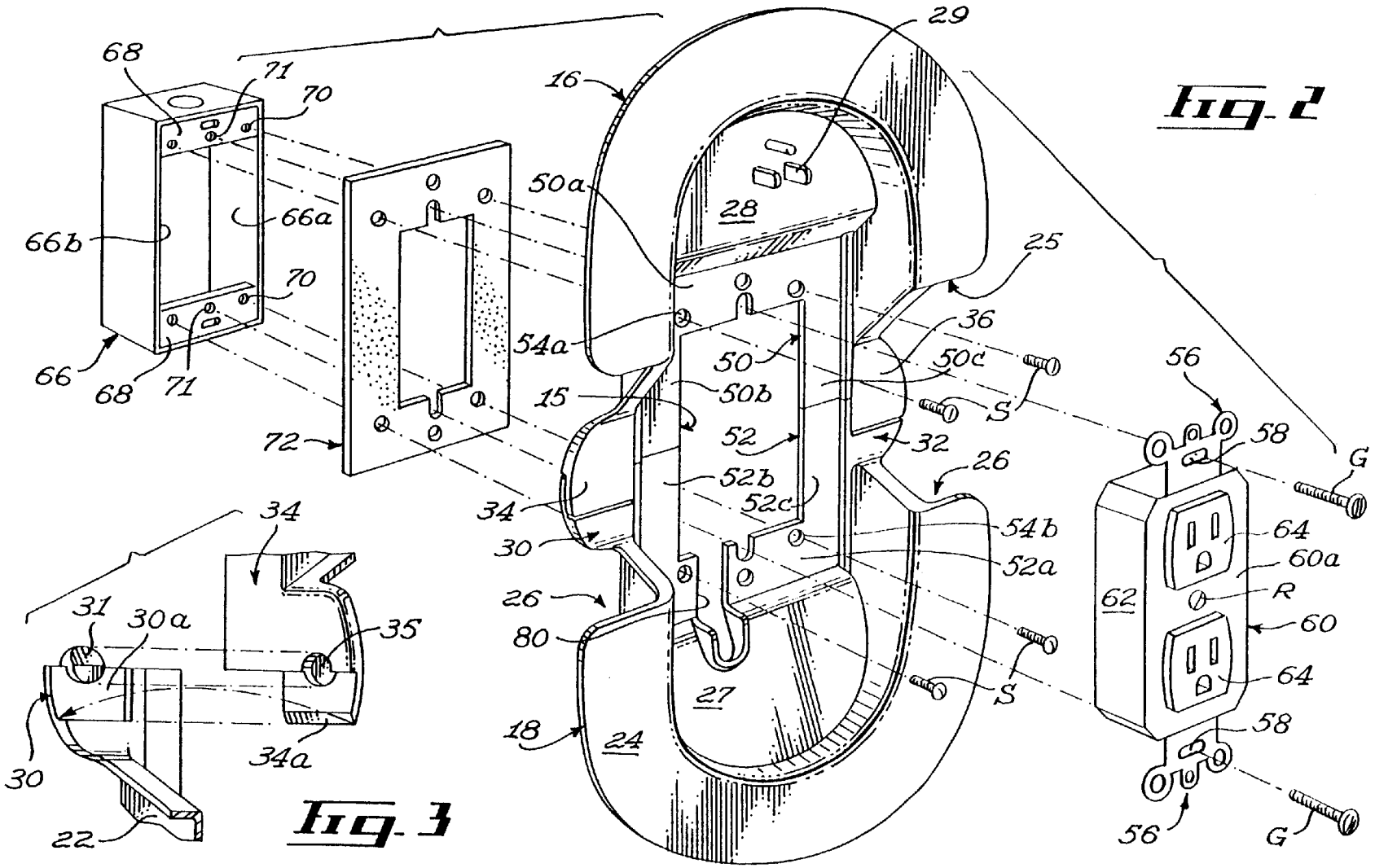
FIG. 2 is an exploded view of the assembly formed by the first embodiment of wall support member and associated electrical outlet and electrical outlet receiving box, the two half sections of the support member being in their engaged condition.
FIG. 3 is an exploded broken perspective view of the male female coupling elements from the two releasable half sections of the support member of FIG. 1, suggesting how the female coupling part can be engaged over the male coupling part.
Figure 4:
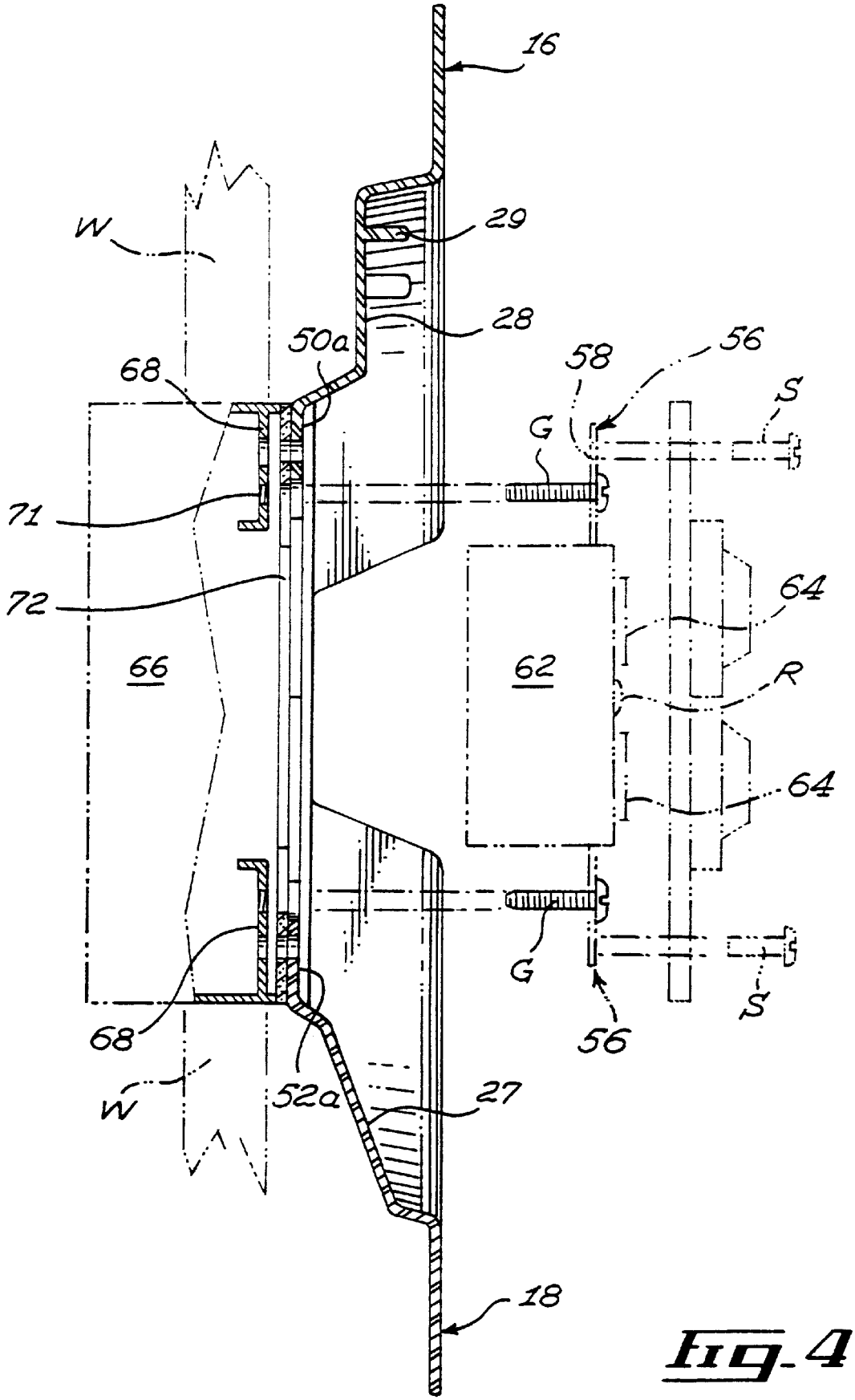
FIG. 4 is a cross-sectional view of the support member of FIG. 1, showing in phantom lines an upright wall against which the support member is mounted, and also showing in phantom lines the electrical outlet and receiving box assembly.

As best seen in FIG. 3, upper ear members 34, 36, each include a transverse cavity 35, 35, and lower ear members 30, 32 each include a transverse tenon member 31, 31, wherein a male-female interconnection is achieved between underlying male members 31, 31 (at the rearward side of spool support 14) and overlying female members 35, 35. In FIG. 3, ear member 34 has been turned upside down relative to adjacent ear member 30, for clarity of the view in showing the female part 35 thereof, but the arrow in FIG. 3 suggests that ear member 34 is to be flipped over ear member 30 while rotating half a turn so that ear members 30, 34, acquire their operative condition of FIG. 2.

Preferably, female ear member 34 (36) includes a tapered ramp 34*a* adjacent cavity 35, and male ear member 30 (32) includes a recess 30*a,* to facilitate sliding interengagement between ear members 30, 32 and ear members 34, 36, respectively, when the two half sections 16, 18, of spool support 14 are brought towards one another.

Preferably, a notch 80 is made into wall 52*a* and coextensively into bridge wall 27. Notch 80 is positioned for example to become laterally offset from the lower socket 64 of electrical outlet 60. Notch 80 is sized to be diametrally larger than electrical cord E, but diametrally smaller than electrical cord plug I. Since the end portion Ea of electrical cord E proximate plug I is accordingly bent to form approximately a half a turn elbow about notch 80, cord E becomes wedged about notch 80 which thus prevents accidental release of plug I from socket 64 as when a pulling force is applied onto the cord E, outwardly beyond its length.

The spool support 14 may be dismantled during the warm winter months, when the extension cord is not required for powering the block heater of the automobile. This dismantling of the spool support 14 can be performed without removing any of the outlet retaining screws G, but simply by slightly untightening same while removing screws S since the top and bottom support members 16, 18, are simply interconnected to one another by friction fit at ears 30–36. The spool support screws are there to allow the spool support 14 to hang spacedly over ground. But more importantly, the two part construction 16, 18, of the present spool support allows the support to be mounted without removing the mounting screws of the electrical connection, provided a gap (FIG. 4) remains between outlet walls 58, 58, and electrical box walls 68, 68, for sliding insertion of the spool support walls 50*a,* 52*a*. Installation thereof can therefore be completed without the professional help of an electrician.

A decorative cover plate (not shown) may be mounted against the free front face 60A of electrical outlet 60, with an intermediate screw R fixedly securing the two together. However, this cover plate is not required for the interlocking of spool support 14 between outlet 60 and box 66, and this cover plate would in the present assembly therefore have no functional feature whatsoever.

For installation in only a few minutes, the following steps are followed:

1. the circuit breaker is put off;
2. the cover plate (not shown) together with an associated sealing pad (not shown) if any, is released from the electrical outlet 60, by unscrewing the central screw R;
3. the screws G extending through bores 58 of outlet 60, are partially untightened - although not released from outlet 60 - to create a gap behind the outlet, between the electrical box and the outlet, this gap having a width greater than the thickness of window frame member 50;
4. a first insulating pad, 72, is mounted between outlet 60 and electrical box 66;
5. the lower arcuate member 18 is slided upwardly in between the lower outlet ear 56 and the first sealing pad 72;
6. the upper arcuate member 16 is slided downwardly in between the upper outlet ear 58 and the first sealing pad 72;
7. mscrews G are retightened into electrical box threaded bores 71, to frictionally take in sandwich the spool support 50 with the outlet ears 56 including the insulating pad 72;
8. four optional screws S may be mounted across support walls 50*a,* 52*a,* to more firmly anchor the support 14 to the electric box 66;
9. the cover plate and associated seal pad are re-tightened against socket outlet 60 by screwing central screw R; and
10. putting "on" once again the circuit breaker of the socket outlet 60.

Figure 5:
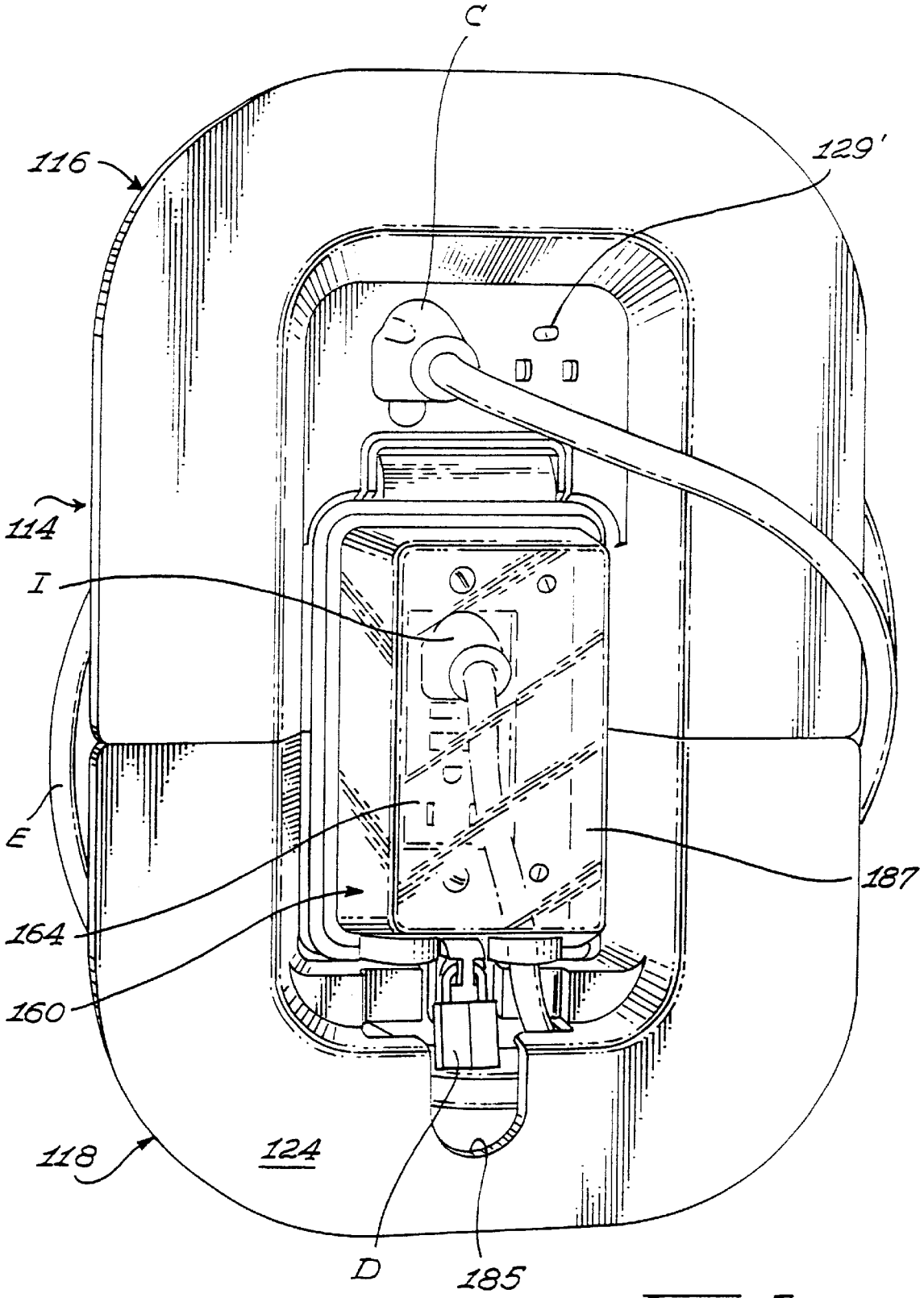
FIG. 5 is a view similar to that of FIG. 2, but for a second embodiment of the invention and further showing a padlock mounted transparent outlet socket cover.
Figure 6:
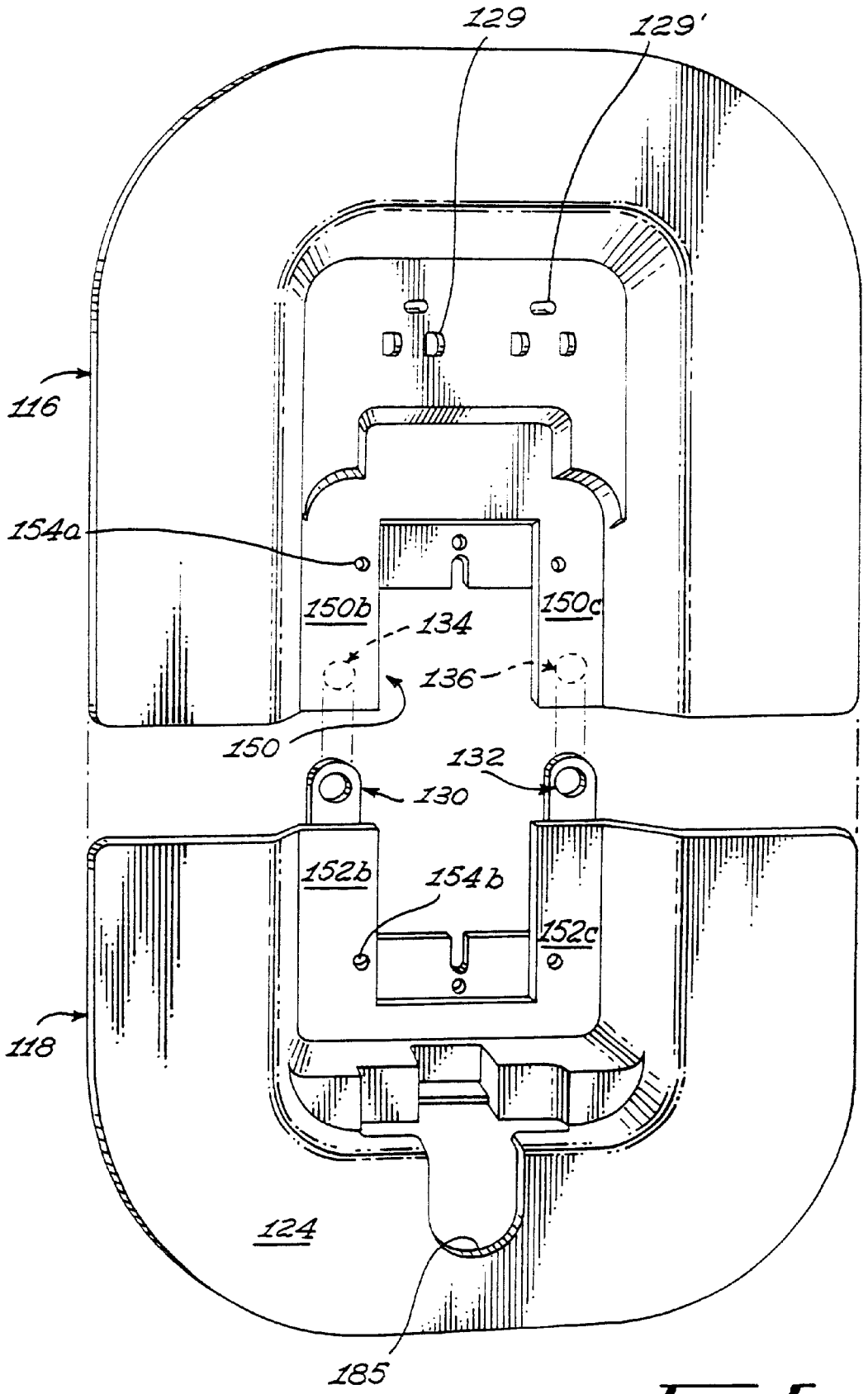
FIG. 6 is a view similar to FIG. 5, but showing only the support member, this support member partly broken for allowing us to see the male female coupling elements between the two releasable half-sections of the support member.

In the second embodiment of the invention, shown in FIGS. 5 and 6 of the drawings, the top and bottom arcuate members 116, 118, are shown as abutting against one another at their free ends so that the coiled electrical cord E behind the spool member 114 is concealed, contrarily to the first embodiment where a gap remained between arcuate members 16, 18, that allowed one to inspect the winded electrical cord behind the spool member 14. A notch 185 is preferably made into an intermediate section of wall 124 of the lower arcuate member 118, to accommodate and enable access to a padlock C provided for releasably locking a transparent cover 187 that covers the sockets 164 of the electrical outlet 160.

In this second embodiment of the invention, the male female ear members 134, 136 and 130, 132, respectively that releasably interconnect the spool support side leg 150*b,* to 152*b* and side leg 150*c* to 152*c* respectively, are not laterally outwardly offset therefrom, as in the first embodiment, but are now coaxial thereto, as clearly shown in FIG. 6. Two (or more) false plugs 129, 129', integral to the spool member 114, could be provided instead of a single one, if desired. Screw bores 154*a,* 154*b,* remain in the upper and lower end sections respectively of window frame member 150.

The present invention applies for example, to power tools, gardening tools, outdoor cooking, temporary lighting on special occasions, but particularly to block heaters used in subfreezing climates. The present spool support 14, 114, allows easy and convenient storage of the electrical extension cord E near the upright wall electrical outlet 60, 160; and alleviates safety hazards associated with electrical connectors laying on moisture-laden ground levels. Although it has been shown in both embodiments as being mounted in upright condition, spool support 14, 114, could alternately be installed in horizontal or inclined fashion.

I claim:

1. A spool support for supporting an elongated electrical cord around an electrical outlet on a wall, said spool support defining:

a) a planar open main frame having a central window, for through engagement by the electrical outlet, and a peripheral edge wall, surrounding said central window, said peripheral edge wall including an upper end section and a lower end section;

b) a first arcuate channel member, integral to said main frame upper end section and projecting forwardly from the plane formed by said main frame;

c) a second arcuate channel member, integral to said main frame lower end section and projection forwardly from the plane formed by said main frame, said first and second channel member extending in opposite directions and forming together a loop for winding therealong the electrical cord; and d) securing means, not associated with an electrical outlet cover plate but operative at said spool support main frame, for releasably anchoring said spool support to this electrical outlet;

wherein said occurring means is operative at least a selected one of said main frame upper end section and lower end section; and wherein said main frame upper end section further includes two integral female ear members and said main frame lower end section further includes two integral male ear members, said male ear members complementarily lockingly releasably engaged with said female ear members; wherein said spool support is dismantleable from an assembled unitary state into a disassembled state in two upper and lower halves.

2. A spool support as in claim 1, further including an upper bridge portion, integrally interconnecting said main frame upper end section and said first arcuate channel member, and a male false plug, integrally projecting transversely from said bridge portion, said male false plug for releasable complementary engagement by a female end connector of the electrical cord when the female end connector is not in use.

3. A spool support as in claim 1, with each of said female ear members has a tapered leading edge, said leading edge forming a ramp enabling sliding interengagement with a corresponding one of said male ear members.

4. A spool support as in claim 1, wherein in said assembled unitary state of said dismantleable spool support, said first and second channel members engage one another to form a continuous single loop member.

5. In combination, an electrical outlet for fitting against an electrical box inside a wall cavity, said electrical outlet having top and bottom ears, and a spool support for supporting an elongated electrical cord around said electrical outlet, said spool support defining:

a) a planar open main frame having a central window, engaged by said electrical outlet, and a peripheral edge wall, surrounding said window, said peripheral edge wall including an upper and a lower end sections;

b) a first arcuate channel member, integral to said main frame upper end section and projection forwardly from the plane formed by said main frame;

c) a second arcuate channel member, integral to said main frame lower end section and projecting forwardly from the plane formed by said main frame, said first and second channel member extending in opposite directions and forming together a loop for winding thereinto the electrical cord; and d) securing means, not associated with an electric outlet cover plate but operative at a selected one of said electrical outlet top and bottom ears and at a corresponding one of said main frame upper and lower end sections, respectively, for releasably and concurrently anchoring said spool support to said electrical outlet and to the electrical box inside the wall cavity;

wherein said main frame upper end section further includes two integral female ear members and said main frame lower end section further includes two integral male ear members, said male ear members complementarily lockingly engageable with said female ear members; wherein said spool support is dismanteable in two upper and lower halves.

6. An electrical outlet and spool support combination as in claim 5, further including an upper bridge portion, integrally interconnecting said main frame upper end section and said first arcuate channel member, and at least one male false plug, integrally projecting transversely from said bridge portion, said at least one false plug for releasable complementary engagement by a female end connector of the electrical extension cord when this female end connector is not in use.

7. An electrical outlet and spool support combination as in claim 5, with each of said female ear members having a tapered leading edge, said leading edge forming a ramp enabling sliding interengagement with corresponding male ear members.

8. An electrical outlet assembly including an electrical box for fitting into a cavity made in an upright wall with said electrical box having a casing with forwardly opening threaded bores, an electrical outlet having a casing engaged into said electrical box for partially projecting outside of the upright wall with said electrical outlet having top and bottom ears, and a spool support sandwiched in between said electrical box and said electrical outlet top and bottom ears, said spool support for supporting in coiled condition an elongated electrical cord around said electrical outlet, said spool support defining:

a) a planar open main frame having a central window, engaged by said electrical outlet, and a peripheral edge wall, surrounding said central window, said peripheral edge wall including upper and lower end sections;

b) a first arcuate channel member, integral to said main frame upper end section and projecting forwardly from the plane formed by said main frame;

c) a second arcuate channel member, integral to said main frame lower end section and projecting forwardly from the plane formed by said main frame, said first and second channel member extending in opposite directions and forming together a loop for winding thereinto the electrical cord; and d) screw means, extending through said electrical outlet top and bottom ears and through corresponding said main frame upper end section and lower end section, respectively , and threadingly into said threaded bores of said electrical box, said screw means releasably lockingly taking in sandwich said spool support main frame between said electrical outlet top ears and said electrical box;

further including an upper bridge portion, integrally interconnecting said main frame upper end section and said first arcuate channel member, and a male false plug, integrally projecting transversely from said bridge portion, said male false plug for releasable complementary engagement by a female end connector of the electrical extension cord.

9. A spool support and electrical outlet assembly as in claim 8, further including an upper bridge portion, integrally interconnecting said main frame upper end section and said first arcuate channel member, and a male false plug, integrally projecting transversely from said bridge portion, said male false plug for releasable complementary engagement by a female end connector of the electrical extension cord.

10. A spool support and electrical outlet assembly as in claim 8, further including additional screw means, extending through said spool support main frame upper end section and lower end section, and through said forwardly opening threaded bores of said electrical box behind said spool support, for more firmly anchoring said spool support to said electrical box;

further including a first and a second electrically insulating sealing pad, said first insulating sealing pad sandwiched in between said electrical box and said spool support main frame upper and lower end sections, said second insulating sealing pad fixedly secured against said electrical outlet forwardly ahead of said outlet top and bottom ears.

11. A spool support and electrical outlet assembly as in claim 8, wherein said main frame upper end section further includes two integral female ear members and said main frame lower end section further includes two integral male ear members, said male ear members complementarily lockingly engageable with said female ear members; wherein said spool support is dismantleable in two upper and lower halves.

12. A spool support and electrical outlet assembly as in claim 11, with each of said female ear members has a tapered leading edge, said leading edge forming a ramp enabling sliding interengagement with a corresponding one of said male ear members.

* * * * *